US010865365B2

(12) United States Patent
Kensicher

(10) Patent No.: US 10,865,365 B2
(45) Date of Patent: Dec. 15, 2020

(54) PHOSPHATE-FREE POLYMER DETERGENT COMPOSITION

(71) Applicant: COATEX, Genay (FR)

(72) Inventor: Yves Kensicher, Theize (FR)

(73) Assignee: COATEX, Genay (FR)

( * ) Notice: Subject to any disclaimer, the term of this patent is extended or adjusted under 35 U.S.C. 154(b) by 71 days.

(21) Appl. No.: 16/306,630

(22) PCT Filed: Jun. 9, 2017

(86) PCT No.: PCT/FR2017/051457
§ 371 (c)(1),
(2) Date: Dec. 3, 2018

(87) PCT Pub. No.: WO2017/216452
PCT Pub. Date: Dec. 21, 2017

(65) Prior Publication Data

US 2019/0177663 A1 Jun. 13, 2019

(30) Foreign Application Priority Data

Jun. 13, 2016 (FR) ..... 16 55433

(51) Int. Cl.
*C11D 1/66* (2006.01)
*C11D 3/37* (2006.01)
*B08B 3/04* (2006.01)

(52) U.S. Cl.
CPC ..... *C11D 3/3757* (2013.01)

(58) Field of Classification Search
CPC ..... C11D 1/66; C11D 3/37; C11D 3/3757; B08B 3/04
See application file for complete search history.

(56) References Cited

U.S. PATENT DOCUMENTS

| | | | | |
|---|---|---|---|---|
| 4,797,223 | A | 1/1989 | Amick et al. | |
| 2001/0036912 | A1 | 11/2001 | Shulman et al. | |
| 2012/0165242 | A1 | 6/2012 | Ng et al. | |
| 2014/0178325 | A1* | 6/2014 | Martinez-Castro .... | C09D 5/024 424/70.16 |

OTHER PUBLICATIONS

International Search Report dated Nov. 6, 2018 in PCT/FR2017/051457 filed Jun. 9, 2017.

* cited by examiner

*Primary Examiner* — Brian P Mruk
(74) *Attorney, Agent, or Firm* — Oblon, McClelland, Maier & Neustadt, L.L.P.

(57) ABSTRACT

The invention relates to the field of detergent compositions, in particular detergent compositions for automatic washing, especially for automatic dishwashing. Thus, the invention provides a phosphate-free detergent composition comprising at least one non-sulfonated nonionic surfactant compound and a non-sulfonated water-soluble copolymer prepared especially by polymerization reaction of acrylic or methacrylic acid, of an acrylic or methacrylic acid, itaconic acid or maleic acid ester and of a compound of formula (I):

(I)

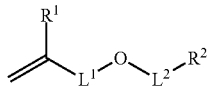

The invention also relates to the use of this non-sulfonated water-soluble copolymer as a scale-inhibiting agent or anti-spotting agent, and also to a cleaning process.

19 Claims, No Drawings

PHOSPHATE-FREE POLYMER DETERGENT COMPOSITION

The invention relates to the field of detergent compositions, in particular detergent compositions for automatic washing, especially for automatic dishwashing. Thus, the invention provides a phosphate-free detergent composition comprising at least one non-sulfonated nonionic surfactant compound and a non-sulfonated water-soluble copolymer prepared especially by polymerization reaction of acrylic or methacrylic acid, of an acrylic or methacrylic acid, itaconic acid or maleic acid ester and of a compound of formula (I):

(I)

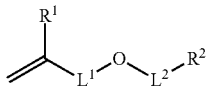

The invention also relates to the use of this non-sulfonated water-soluble copolymer as a scale-inhibiting agent or anti-spotting agent, and also to a cleaning process.

EP 324 568 describes a detergent composition comprising a water-soluble polymer. EP 995 791 also describes a polymer for a detergent composition. EP 2 468 843 describes a detergent composition comprising a HASE copolymer. EP 2 935 358 describes a thickening HASE copolymer which is useful as an anti-sedimentation agent for paint compositions.

The detergent compositions of the prior art have a certain number of problems. In particular, the presence of phosphates in the detergent compositions leads to environmental problems.

Phosphate-free automatic dishwashing compositions exist. Such compositions nevertheless comprising water-soluble copolymers prepared from phosphate-based monomers are especially known. Thus, the presence of phosphate residues in these copolymers may prove to be problematic.

Besides the presence of such phosphate residues in copolymers employed in known detergent compositions, these detergent compositions do not always allow significant performance improvements during washing and especially during dishwashing. Thus, such detergent compositions do not always make it possible to avoid the formation of scale or water marks on tableware, in particular during automatic dishwashing. Such problems are particularly to be avoided when washing glasses or glass tableware items.

Specifically, the formation of scale deposits and the appearance of water marks on tableware lead to aesthetic problems, but may also lead to other problems during the subsequent use of the tableware.

Detergent compositions that are phosphate-free or that contain a low concentration of phosphates, which comprise copolymers bearing sulfonated residues, are known. Such detergent compositions do not afford entirely satisfactory performance when compared with phosphate-based detergent compositions. In particular, such "phosphate-free" detergent compositions comprising copolymers bearing sulfonated residues have defects during the washing of tableware, both as regards the efficiency of washing and as regards the ability to prevent scale marks or water marks.

Thus, the substances generally used in replacement for phosphates in detergent compositions do not give an acceptable or satisfactory result.

Moreover, the insoluble or sparingly soluble matter leading to the formation of scale deposits on tableware, especially magnesium or calcium carbonates or silicates, also lead to problems during laundry washing.

There is thus a need for a phosphate-free polymeric detergent composition which has improved properties. In particular, there is a need for a phosphate-free detergent composition for combating scale deposits, and which has good film-forming efficacy or good efficacy in reducing or eliminating water marks during automatic dishwashing.

The invention provides a solution to all or some of the problems encountered with the phosphate-free polymeric detergent compositions of the prior art. In particular, the invention makes it possible to combat nucleation and to combat crystal growth leading to the formation of scale.

Thus, the invention provides a phosphate-free detergent composition comprising:

at least one non-sulfonated water-soluble copolymer prepared by polymerization reaction:

a) of 55 mol % to 93 mol % of at least one acid chosen from acrylic acid and methacrylic acid, mixtures thereof and salts thereof, b) of 2 mol % to 25 mol % of at least one ester of a compound derived from an acid chosen from acrylic acid, methacrylic acid, itaconic acid and maleic acid, and c) of 5 mol % to 20 mol % of at least one compound of formula (I):

(I)

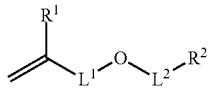

in which:

$R^1$ and $R^2$, which may be identical or different, independently represent H or $CH_3$, $L^1$ independently represents a group chosen from C(O), $CH_2$, $CH_2$—$CH_2$ and O—$CH_2CH_2$—$CH_2$—$CH_2$, $L^2$ independently represents a group chosen from $(CH_2—CH_2O)_x$, $(CH_2CH(CH_3)O)_y$, $(CH(CH_3)CH_2O)_z$ and combinations thereof, and x, y and z, which may be identical or different, independently represent an integer or decimal number between 0 and 150, x is strictly greater than y+z and the sum x+y+z is between 10 and 150, and at least one non-sulfonated nonionic surfactant compound.

The invention also provides a phosphate-free detergent composition comprising:

at least one non-sulfonated water-soluble copolymer prepared by polymerization reaction:

d) of 55% to 93% by weight of at least one acid chosen from acrylic acid and methacrylic acid, mixtures thereof and salts thereof, e) of 2% to 25% by weight of at least one ester of a compound derived from an acid chosen from acrylic acid, methacrylic acid, itaconic acid and maleic acid, and f) of 5% to 20% by weight of at least one compound of formula (I):

(I)

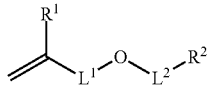

in which:

$R^1$ and $R^2$, which may be identical or different, independently represent H or $CH_3$, $L^1$ independently represents a group chosen from C(O), $CH_2$, $CH_2$—$CH_2$ and O—$CH_2CH_2$—$CH_2$—$CH_2$, $L^2$ independently represents a group chosen from $(CH_2—CH_2O)_x$, $(CH_2CH(CH_3)O)_y$, $(CH(CH_3)CH_2O)_z$ and combinations thereof, and x, y and z, which may be identical or different, independently represent an integer or decimal number between 0 and 150, x is strictly greater than y+z and the sum x+y+z is between 10 and 150, and at least one non-sulfonated nonionic surfactant compound.

Thus, in a particularly advantageous manner for the composition according to the invention, monomers (a), (b) and (c) used in the preparation of the copolymer and the surfactant compound are non-sulfonated compounds.

The non-sulfonated water-soluble copolymer used according to the invention results from the use of at least three types of monomers, monomers (a), (b) and (c), which are different from each other.

This is a copolymer which is different from an HASE copolymer. The copolymer used according to the invention is water-soluble, especially in acidic medium.

This non-sulfonated water-soluble copolymer may also be characterized by its weight-average molecular mass ($M_W$). Preferably, it has a weight-average molecular mass ranging from 2,000 g/mol to 100,000 g/mol or from 5,000 g/mol to 50,000 g/mol or alternatively from 7,000 g/mol to 20,000 g/mol. Such copolymers with an $M_w$ of 8,000 g/mol, 9,000 g/mol, 10,000 g/mol, 11,000 g/mol or 12,000 g/mol are particularly preferred. According to the invention, the molecular weight of the copolymers is determined by Size Exclusion Chromatography (SEC) or Gel Permeation Chromatography (GPC). This technique uses a Waters brand liquid chromatography machine equipped with a detector. This detector is a Waters brand refractometric concentration detector. This liquid chromatography apparatus is equipped with a size exclusion column so as to separate the various molecular weights of the copolymers under study. The liquid elution phase is an aqueous phase adjusted to pH 9.00 using 1 N sodium hydroxide containing 0.05 M of $NaHCO_3$, 0.1 M of $NaNO_3$, 0.02 M of triethanolamine and 0.03% of $NaN_3$.

According to a first step, the copolymer solution is diluted to 0.9% dry weight in the SEC dissolution solvent, which corresponds to the SEC liquid elution phase to which is added 0.04% of dimethylformamide which serves as flow marker or internal calibration. The resulting solution is then filtered at 0.2 μm. 100 μL are then injected into the chromatography machine (eluent: an aqueous phase adjusted to pH 9.00 with 1N sodium hydroxide containing 0.05 M of $NaHCO_3$, 0.1 M of $NaNO_3$, 0.02 M of triethanolamine and 0.03% of $NaN_3$).

The liquid chromatography machine contains an isocratic pump (Waters 515), the flow rate of which is set at 0.8 mL/minute. The chromatography machine also comprises an oven which itself comprises in series the following column system: a precolumn of Waters Ultrahydrogel Guard Column type 6 cm long and with an inside diameter of 40 mm, and a linear column of Waters Ultrahydrogel type 30 cm long and with an inside diameter of 7.8 mm. The detection system is composed of a Waters RI 410 refractometric detector. The oven is brought to a temperature of 60° C. and the refractometer is brought to a temperature of 45° C.

The chromatography machine is calibrated using sodium polyacrylate powder standards of different molecular masses certified by the supplier: Polymer Standard Service or American Polymer Standards Corporation.

Preferably for the invention, the acid (a) is acrylic acid or an acrylic acid salt. Also preferably for the invention, the copolymer is prepared by reacting from 55 mol % to 90 mol %, preferably from 60 mol % to 85 mol %, more preferentially from 65 mol % to 80 mol % of acid (a), in particular of acrylic acid or of an acrylic acid salt.

Preferably for the invention, the acid (a) is acrylic acid or an acrylic acid salt. Also preferably for the invention, the copolymer is prepared by reacting from 55% to 90% by weight, preferably from 60% to 85% by weight, more preferentially from 65% to 80% by weight of acid (a), in particular of acrylic acid or of an acrylic acid salt.

According to the invention, the ester (b) may be an anionic ester or a nonionic ester. According to the invention, the ester (b) may also be a hydrophilic ester or a hydrophobic ester, and is preferably a hydrophobic ester. Also preferably, the ester (b) is an acrylic acid ester, preferably methyl acrylate, ethyl acrylate, butyl acrylate, hydroxypropyl acrylate, ethylene glycol acrylate or propylene glycol acrylate, more preferentially ethyl acrylate; or a methacrylic acid ester, preferably methyl methacrylate, ethyl methacrylate, butyl methacrylate, hydroxypropyl methacrylate, ethylene glycol methacrylate or propylene glycol methacrylate. Also preferably for the invention, the copolymer is prepared by reacting from 5 mol % to 20 mol %, preferably from 7 mol % to 15 mol % of ester (b), in particular methyl acrylate, ethyl acrylate, hydroxypropyl acrylate or butyl acrylate, preferably ethyl acrylate or hydroxypropyl acrylate. Also preferably for the invention, the copolymer is prepared by reacting from 5% to 20% by weight, preferably from 7% to 15% by weight of ester (b), in particular methyl acrylate, ethyl acrylate, hydroxypropyl acrylate or butyl acrylate, preferably ethyl acrylate or hydroxypropyl acrylate.

According to the invention, a compound (c) of formula (I) that is preferred for the preparation of the non-sulfonated water-soluble copolymer is a compound for which:

$R^1$ and $R^2$ represent H or $CH_3$ or $L^1$ represents a group chosen from C(O) and $CH_2$ or $L^2$ represents a group combining $(CH_2—CH_2O)_x$ and $(CH_2CH(CH_3)O)_y$ or $(CH(CH_3)CH_2O)_z$ or x represents an integer or decimal number between 10 and 140 or y+z represents an integer or decimal number between 10 and 140 or x is strictly greater than y+z and the sum x+y+z is between 10 and 150.

According to the invention, a compound (c) of formula (I) that is more preferred is a compound for which $R^1$ and $R^2$ represent H, $L^1$ represents a group chosen from C(O) and $CH_2$, $L^2$ represents a group combining $(CH_2—CH_2O)_x$ and $(CH_2CH(CH_3)O)_y$ or $(CH(CH_3)CH_2O)_z$, x represents an integer or decimal number between 10 and 140, y+z represents an integer or decimal number between 10 and 140 and x is strictly greater than y+z and the sum x+y+z is between 10 and 150.

According to the invention, a compound (c) of formula (I) that is more preferred is a compound for which $R^1$ represents $CH_3$, $R^2$ represents H, $L^1$ represents a C(O) group, $L^2$ represents a group combining $(CH_2—CH_2O)_x$ and $(CH_2CH(CH_3)O)_y$ or $(CH(CH_3)CH_2O)_z$, x represents an integer or decimal number between 10 and 140, y+z represents an integer or decimal number between 10 and 140 and x is strictly greater than y+z and the sum x+y+z is between 10 and 150.

According to the invention, a compound (c) of formula (I) that is also more preferred is a compound for which $R^1$ represents $CH_3$, $R^2$ represents $CH_3$, $L^1$ represents a C(O) group, $L^2$ represents a group combining $(CH_2—CH_2O)_x$ and $(CH_2CH(CH_3)O)_y$ or $(CH(CH_3)CH_2O)_z$, x represents an integer or decimal number between 10 and 140, y+z represents an integer or decimal number between 10 and 140 and x is strictly greater than y+z and the sum x+y+z is between 10 and 150.

According to the invention, a compound (c) of formula (I) that is also more preferred is a compound for which $R^1$ and $R^2$ represent H, $L^1$ represents C(O), $L^2$ represents $(CH_2CH_2O)_x$ and x represents 1.

According to the invention, a compound (c) of formula (I) that is also more preferred is a compound for which $R^1$ and $R^2$ represent H, $L^1$ represents C(O), $L^2$ represents $(CH_2CH(CH_3)O)_y$ or $(CH(CH_3)CH_2O)_z$ and y+z represents 1.

According to the invention, a compound (c) of formula (I) that is also more preferred is a compound for which $R^1$ represents $CH_3$, $R^2$ represent H, $L^1$ represents C(O), $L^2$ represents a group $(CH_2—CH_2O)$ and x represents 1.

According to the invention, a compound (c) of formula (I) that is also more preferred is a compound for which $R^1$ represents $CH_3$, $R^2$ represent H, $L^1$ represents C(O), $L^2$ represents a group $(CH_2CH(CH_3)O)_y$ or $(CH(CH_3)CH_2O)_z$ and y+z represents 1.

According to the invention, a compound (c) of formula (I) that is also more preferred is a compound for which $R^1$ represents $CH_3$, $R^2$ represents H, $L^1$ represents $CH_2$, $L^2$ represents a group combining $(CH_2—CH_2O)_x$ and $(CH_2CH(CH_3)O)_y$ or $(CH(CH_3)CH_2O)_7$, x represents an integer or decimal number between 10 and 140, y+z represents an integer or decimal number between 10 and 140 and x is strictly greater than y+z and the sum x+y+z is between 10 and 150.

According to the invention, a compound (c) of formula (I) that is also more preferred is a compound for which $R^1$ represents $CH_3$, $R^2$ represent H, $L^1$ represents $CH_2$, $L^2$ represents $(CH_2—CH_2O)_x$ and x represents an integer or decimal number between 10 and 140.

According to the invention, a compound (c) of formula (I) that is also more preferred is a compound for which $R^1$ and $R^2$ represent H, $L^1$ represents $O—CH_2—CH_2—CH_2—CH_2$, $L^2$ represents $(CH_2—CH_2O)$, and x represents an integer or decimal number between 10 and 140.

In a particularly preferred manner, compound (c) of formula (I) is a compound for which:

- x represents an integer or decimal number between 15 and 140,
- y+z represents an integer or decimal number between 10 and 135 and
- x is strictly greater than y+z and the sum x+y+z is between 10 and 150.

More preferably, compound (c) is a compound of formula (I) for which x represents an integer or decimal number between 15 and 80 and y+z represents an integer or decimal number between 10 and 65, preferably a compound of formula (I) for which x represents an integer or decimal number between 30 and 65 and y+z represents an integer or decimal number between 15 and 40, especially a compound of formula (I) for which x represents an integer or decimal number between 40 and 60 and y+z represents an integer or decimal number between 20 and 30, for example a compound of formula (I) for which x represents 50 and y represents 25.

In a particularly preferred manner, the copolymer is prepared by reacting 7 mol % to 18 mol %, preferably 7 mol % to 15 mol %, of compound (c) of formula (I). In a manner that is also particularly preferred, the copolymer is prepared by reacting 7% to 18% by weight, preferably 7% to 15% by weight, of compound (c) of formula (I).

Besides the monomers (a), (b) and (c), the non-sulfonated water-soluble copolymer used according to the invention may also be prepared by polymerization reaction also using a monomer (d).

Preferably according to the invention, monomer (d) is chosen from maleic acid, itaconic acid and crotonic acid, mixtures thereof and salts thereof. Also preferably, monomer (d) is used in a weight amount ranging from 1/20 to 1/3, relative to the amount of monomer (a).

The copolymer prepared according to the invention is thus obtained via a polymerization reaction. This reaction may be a radical polymerization reaction, for example an emulsion, dispersion or solution polymerization reaction. The polymerization may be performed in water or in a solvent, in the presence of at least one initiator compound. Examples of initiator compounds that are known include persulfate salts, especially ammonium persulfate, sodium persulfate and potassium persulfate.

According to the invention, the amounts of non-sulfonated water-soluble copolymer and of non-sulfonated nonionic surfactant compound may vary within a relatively wide range. Preferably, the detergent composition according to the invention comprises from 1% to 15% by weight, preferably from 2% to 10% by weight, of non-sulfonated water-soluble copolymer. More preferentially, it comprises from 4% to 8% by weight, for example 6% by weight, of non-sulfonated water-soluble copolymer.

According to the invention, the amounts of monomers, in particular the amounts of monomers (a), (b) and (c), used are expressed as molar or weight percentages relative to the total amount of monomers used in the preparation of the non-sulfonated water-soluble copolymer.

Besides the particular non-sulfonated water-soluble copolymer, the detergent composition according to the invention also comprises at least one nonionic surfactant compound that is non-sulfonated. Preferably, the nonionic surfactant compound comprises ethoxylated chains or propoxylated chains or alternatively it combines ethoxylated chains and propoxylated chains. More preferably, it is a block copolymer comprising ethoxylated chains and propoxylated chains.

Preferably, the nonionic surfactant compound present in the detergent composition according to the invention is a block copolymer which is nonionic and non-foaming. This surfactant compound is non-sulfonated.

Examples of non-sulfonated nonionic surfactant compounds that may be mentioned include synthetic alcohol ethoxylates, alcohol ethoxylates of natural origin, tributyl phenol ethoxylates, nonyl phenol ethoxylates, block polymers of ethylene oxide and of propylene oxide, adducts of ethoxylated-propoxylated alcohols, fatty acid ethoxylates, fatty amine ethoxylates, castor oil ethoxylates, tristyryl phenol ethoxylates and alkyl polyglycosides. A preferred group of non-sulfonated nonionic surfactant compounds comprises block polymers of ethylene oxide and of propylene oxide comprising 10% of ethylene oxide, adducts of $C_{10}$-$C_{12}$ ethoxylated-propoxylated fatty alcohols, adducts of $C_{12}$-$C_{14}$ ethoxylated-propoxylated fatty alcohols, adducts of $C_{12}$-$C_{15}$ ethoxylated-propoxylated oxo-alcohols, adducts of $C_{12}$-$C_{18}$ ethoxylated-propoxylated oxo-alcohols, $C_{12}$-$C_{14}$ fatty alcohol ethoxylates comprising 10 ethylene oxide groups and bearing a butyl end function, $C_{12}$-$C_{18}$ fatty alcohol ethoxylates comprising 5 ethylene oxide groups and bearing a butyl end function, $C_{12}$-$C_{18}$ fatty alcohol ethoxylates comprising 10 ethylene oxide groups and bearing a butyl end function, $C_{12}$-$C_{15}$ oxo-alcohol ethoxylates comprising 8 ethylene oxide groups, $C_{12}$-$C_{15}$ oxo-alcohol ethoxylates comprising 8 ethylene oxide groups, $C_{12}$-$C_{15}$ oxo-alcohol ethoxylates comprising 10 ethylene oxide groups, poly($C_6$-hexyl glycosides) and poly($C_8$-alkyl glucosides).

Preferably, the detergent composition according to the invention comprises from 0.3% to 30% by weight of nonionic surfactant compound, more preferentially from 0.5% to 20% by weight or from 1% to 8% by weight.

According to the invention, the detergent composition may also comprise at least one detergency adjuvant (builder) or one or more substances chosen from:

- at least one filler, especially a solid filler, for example a zeolite-based filler,
- a bleaching or decolorizing agent,
- a bleaching activating or catalyzing agent,
- an enzyme,
- an agent for limiting glass corrosion,
- a fragrance and
- a tablet disintegrating agent.

Generally, a builder combines several properties such as removing or chelating the $Ca^{2+}$ and $Mg^{2+}$ ions present in the washing water and on the articles to be washed, making the medium basic, improving the performance of the surfactant compounds, desorbing the soiling and keeping it in the cleaning medium. Preferably according to the invention, the detergent composition comprises at least one organic or mineral non-phosphate builder. More preferentially, it is chosen from the sodium salt of nitriloacetic acid (NTA), sodium aluminosilicates or zeolite A, carbonates such as sodium carbonates, citrates such as sodium citrates, especially sodium tricitrate, silicates such as sodium silicates, gluconic acid and salts thereof, especially the sodium salts thereof, glutamic acid and salts thereof, the tetrasodium salt of N,N-diacetic acid, EDTA (ethylenediaminetetraacetic acid), MGDA (methyl glycine diacetate), EDDS (ethylenediamine-N,N'-disuccinic acid), IDSA (iminodisuccinic acid), the sodium salt of iminosuccinic acid, and mixtures thereof. Preferably, the invention also provides a detergent composition for automatic dishwashing, which comprises at least one detergent composition according to the invention. This detergent composition for automatic dishwashing may also comprise:

- at least one solid filler which is not zeolite-based,
- a bleaching or decolorizing agent, optionally combined with a bleaching activating or catalyzing agent,
- an enzyme,
- a tablet disintegrating agent and
- optionally, an agent for limiting glass corrosion or a fragrance.

These additional substances present in the detergent composition according to the invention are known per se. They may be chosen as a function of their known properties and they may be used under conditions and in amounts that are known per se.

The detergent composition according to the invention may be in various forms. It may be in a solid, liquid or gel form. Preferably, it is in a solid form, for example in the form of powder or granules or in the form of tablets, for example multilayer tablets. The detergent composition for automatic dishwashing according to the invention is preferably in the form of powder or granules or in the form of tablets, for example multilayer tablets. The invention also relates to the use of at least one non-sulfonated water-soluble copolymer defined for the detergent composition according to the invention, as a scale-inhibiting agent. The invention also relates to the use of at least one non-sulfonated water-soluble copolymer defined for the detergent composition according to the invention, as an anti-spotting agent. The invention also relates to the use of at least one non-sulfonated water-soluble copolymer defined for the detergent composition according to the invention, as a scale-inhibiting and anti-spotting agent.

Preferably, the invention relates to such uses in a detergent composition also comprising at least one non-sulfonated nonionic surfactant compound.

Similarly, the invention relates to a cleaning process comprising the use of at least one detergent composition according to the invention. Preferably, the cleaning process according to the invention comprises the use of water and of at least one detergent composition according to the invention. Preferentially, the cleaning process comprises:

- washing using water and at least one detergent composition according to the invention,
- rinsing and
- drying.

Advantageously, the cleaning process according to the invention is performed for washing or cleaning which is chosen from washing a vehicle, especially a motor vehicle, detergency, especially household detergency, laundry washing, especially automatic laundry washing, washing or cleaning tableware, especially automatic dishwashing or cleaning, washing assistance, and surface cleaning. Preferably, the cleaning process according to the invention is performed for automatic dishwashing or cleaning.

The particular, advantageously or preferred characteristics of the copolymer of the detergent composition according to the invention make it possible to define particular, advantageously or preferred uses and cleaning and washing processes according to the invention.

The examples that follow make it possible to illustrate the various aspects of the invention.

EXAMPLES

A non-sulfonated copolymer P1 according to the invention is prepared.

277.5 g of water and 0.052 g of iron sulfate heptahydrate are placed in a 1,000 mL reactor equipped with a mechanical stirrer, an oil-bath heater and temperature measurement allowing heat regulation. Three peristaltic pumps allow simultaneous injection of the following reagents:

- mixture 1, in a first tank:
  - 379.75 g of acrylic acid (M1),
  - 49 g of ethyl acrylate (M2) and
  - 61.25 g of PEM (M3) (polyalkylene glycol methacrylate of $M_w$ 3,000 g/mol and composed of 70% by mass of units resulting from the cycloaddition of ethylene oxide and 30% by mass of units resulting from the cycloaddition of propylene oxide),
- mixture 2, in a second tank; this is a solution made of:
  - 3.65 g of sodium persulfate and
  - 60 g of water and
- mixture 3, in a third tank; this is a solution made of:
  - 55.76 g of 40% sodium bisulfite and
  - 10 g of water.

The polymerization reactor is heated to 73° C. and the three mixtures are injected as follows:

mixtures 1 and 2 are injected simultaneously into the polymerization reactor at a constant speed over 210 minutes and mixture 3 is injected at a constant speed simultaneously with mixtures 1 and 2, but over 220 minutes.

During the injection, the temperature is maintained at 73° C.±2° C.

The pumps are then rinsed with 70 g of water and the whole is heated at 73° C. for 30 minutes.

The solution is then cooled to 60° C. and 8.5 g of aqueous 35% hydrogen peroxide solution are added.

The whole is then heated for 30 minutes and then cooled to room temperature.

The polymer in solution is then collected and analyzed by SEC; it has the following characteristics: $M_w$=9,535 g/mol and Ip=3.2.

Similarly, other polymers according to the invention are prepared by varying the proportions of the monomers. The reagents, especially the monomers M1, M2 and M3, used, the reaction conditions and the characteristics of the polymers prepared are presented in table 1.

TABLE 1

| Polymer | P2 | P3 | P4 | P5 |
|---|---|---|---|---|
| M1 (g) | 416.50 | 392.00 | 355.25 | 379.75 |
| M2 (g) | 61.25 | 61.25 | 61.25 | 61.25 |
| M3 (g) | 12.25 | 36.75 | 73.50 | 49.00 |
| $M_w$ (g/mol) | 10 750 | 11 110 | 10 560 | 10 890 |
| Ip | 3.1 | 3.2 | 3.1 | 3.2 |

Similarly, other polymers according to the invention are prepared by varying the monomers and the proportions thereof. The reagents, especially the monomers M4 (hydroxypropyl acrylate), M5 (polyalkylene glycol methacrylate of $M_w$ 2,000 g/mol and composed of 85% by mass of units resulting from the cycloaddition of ethylene oxide and of 15% by mass of units resulting from the cycloaddition of propylene oxide, as an aqueous solution at 50% by weight) and M6 (methallyl polyethylene glycol of $M_w$ 2,400 g/mol as an aqueous solution at 60% by weight), used, the reaction conditions and the characteristics of the polymers prepared are presented in table 2.

TABLE 2

| Polymer | P6 | P7 | P8 |
|---|---|---|---|
| M1 (g) | 297.17 | 297.17 | 297.16 |
| M2 (g) | / | 38.34 | 38.34 |
| M3 (g) | 47.93 | / | / |
| M4 (g) | 38.34 | / | / |
| M5 (g) | / | 95.86 | / |
| M6 (g) | / | / | 79.88 |
| $M_w$ (g/mol) | 9,790 | 8,655 | 8,670 |
| Ip | 3.4 | 3.0 | 3.1 |

The efficacy of the copolymers according to the invention and of known comparative polymers is then compared.

The first comparative polymer CP1 is a sodium polyacrylate derived from an acrylic homopolymer in the form totally neutralized with sodium (Acusol 445 NG product from Röhm & Haas), its weight-average molecular mass (MW) is 4,500 g/mol.

The second comparative polymer CP2 is a sulfonated acrylic copolymer in the form partially neutralized with sodium (Acusol 588 G product from Röhm & Haas), its weight-average molecular mass ($M_W$) is 12,000 g/mol.

Using the various polymers, detergent compositions are prepared in the form of a dishwasher powder comprising sodium citrate, sodium metasilicate, a non-foaming nonionic surfactant compound and 1 g of the test polymer in dry granulated form. The performance qualities of the polymers are evaluated by means of washing tests on tableware including glass plates, enamelled ceramic plates, bakelite plates and also glasses and stainless-steel cutlery. The dishwashers used are of the Miele brand, model G4920SC, and the intensive washing program at a temperature of greater than or equal to 75° C. is used. Beforehand, the ion-exchange resins used in the dishwashers to soften the washing and rinsing water are saturated with calcium salts to make them inoperative. No resin-regenerating salt is used for the washes.

The dishwasher is filled with the tableware and the intensive program is then selected. The program begins by rinsing with cold water for 10 minutes. After this rinse, a dose of 50 g of standardized soiling is introduced manually into the dishwasher along with 17 g of washing powder especially comprising the test polymer. Washing then continues for one hour; after 30 minutes, the temperature reaches 75° C.

After one hour of washing, the water is discharged automatically and a first rinse with water at 40° C. is performed, followed by a second rinse with water at 70° C. for 15 minutes. The water of the second rinse is then discharged and the dishwasher is stopped. The tableware dries naturally for 30 minutes after opening the dishwasher.

Washing is repeated under the same conditions. For each polymer, a series of 30 washes is performed.

After 30 washes, the polymers are compared by visual inspection of the glasses placed next to each other in a black box illuminated with zenithal lighting. A score from 0 to 10 is attributed during each inspection of the glasses: 0 for a totally opaque glass and 10 for a new unwashed glass. The results obtained are shown in table 3.

TABLE 3

| Reference of the test according to the polymer | Score |
|---|---|
| New glass | 10 |
| Known sodium polyacrylate CP1-$M_w$ 4,500 g/mol | 2 |
| Known sulfonated polymer CP2-$M_w$ 12,000 g/mol | 9 |
| Polymer P1 according to the invention-$M_w$ 9,535 g/mol | 9 |
| Polymer P3 according to the invention-$M_w$ 11,110 g/mol | 9 |
| Polymer P4 according to the invention-$M_w$ 10,560 g/mol | 9 |
| Polymer P5 according to the invention-$M_w$ 10,890 g/mol | 10 |
| Polymer P6 according to the invention-$M_w$ 9,790 g/mol | 10 |
| Polymer P7 according to the invention-$M_w$ 8,655 g/mol | 10 |
| Polymer P8 according to the invention-$M_w$ 8,670 g/mol | 10 |

The washes performed using the compositions according to the invention make it possible to remove all of the soiling. Absence of a continuous scale film on the surface of the washed tableware is observed, in particular on the glass tableware, especially the glasses. The washed tableware does not bear any visible water marks.

The compositions according to the invention afford efficacy very much superior to that obtained using the known sodium polyacrylate and of the same level as that obtained with the known sulfonated polymer.

The invention claimed is:

1. A phosphate-free detergent composition comprising:

at least one non-sulfonated water-soluble copolymer chosen from:

(i) a non-sulfonated water-soluble copolymer prepared by polymerization reaction:

a) of 55 mol % to 93 mol % of at least one acid chosen from acrylic acid and methacrylic acid, mixtures thereof and salts thereof, b) of 2 mol % to 25 mol % of at least one ester of a compound derived from an acid chosen from acrylic acid, methacrylic acid, itaconic acid and maleic acid, and c) of 5 mol % to 20 mol % of at least one compound of formula (I):

(I)

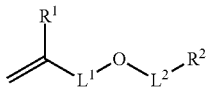

wherein:

$R^1$ represents H or $CH_3$, $R^2$ represents H, $L^1$ independently represents a group chosen from C(O), $CH_2$, $CH_2$—$CH_2$ and O—$CH_2CH_2$—$CH_2$—$CH_2$, $L^2$ independently represents a group chosen from $(CH_2\text{-}CH_2O)_x$, $(CH_2CH(CH_3)O)_y$, $(CH(CH_3)CH_2O)_z$ and combinations thereof, and x, y and z, which may be identical or different, independently represent an integer or decimal number between 0 and 150, x is strictly greater than y+z and the sum x+y+z is between 10 and 150, and (ii) a non-sulfonated water-soluble copolymer prepared by polymerization reaction:

a) of 55% to 93% by weight of at least one acid chosen from acrylic acid and methacrylic acid, mixtures thereof and salts thereof, b) of 2% to 25% by weight of at least one ester of a compound derived from an acid chosen from acrylic acid, methacrylic acid, itaconic acid and maleic acid, and c) of 5% to 20% by weight of at least one compound of formula (I):

(I)

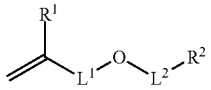

wherein:

$R^1$ represents H or $CH_3$, $R^2$ represents H, $L^1$ independently represents a group chosen from C(O), $CH_2$, $CH_2$—$CH_2$ and O—$CH_2CH_2$—$CH_2$—$CH_2$, $L^2$ independently represents a group chosen from $(CH_2—CH_2O)_x$, $(CH_2CH(CH_3)O)_y$, $(CH(CH_3)CH_2O)_z$ and combinations thereof, and x, y and z, which may be identical or different, independently represent an integer or decimal number between 0 and 150, x is strictly greater than y+z and the sum x+y+z is between 10 and 150; and at least one non-sulfonated nonionic surfactant compound.

2. The detergent composition as claimed in claim 1, wherein:

the acid (a) is acrylic acid or an acrylic acid salt or the copolymer is prepared by reacting from 55 mol % to 90 mol % of acid (a) or the copolymer is prepared by reacting from 55% to 90% by weight of acid (a).

3. The detergent composition as claimed in claim 1, wherein:

the ester (b) is an anionic or nonionic ester or is a hydrophilic ester or a hydrophobic ester, or the copolymer is prepared by reacting from 5 mol % to 20 mol % of ester (b) or the copolymer is prepared by reacting from 5% to 20% by weight of ester (b).

4. The detergent composition as claimed in claim 1, wherein the compound (c) of formula (I) is a compound wherein:

$R^1$ represents H.

5. The detergent composition as claimed in claim 1, wherein compound (c) of formula (I) is a compound wherein:

$R^1$ and $R^2$ represent H, $L^1$ represents a group chosen from C(O) and $CH_2$, $L^2$ represents a group combining $(CH_2—CH_2O)_x$ and $(CH_2CH(CH_3)O)_y$ or $(CH_2(CH_3)CH_2O)_z$, x represents an integer or decimal number between 10 and 140, y+z represents an integer or decimal number between 10 and 140, and x is strictly greater than y+z and the sum x+y+z is between 20 and 150.

6. The detergent composition as claimed in claim 1, wherein compound (c) is:

a compound of formula (I) for which x represents an integer or decimal number between 15 and 80 and y+z represents an integer or decimal number between 10 and 65.

7. The detergent composition as claimed in claim 1, wherein compound (c) is chosen from:

a compound of formula (I) in which $R^1$ represents $CH_3$, $R^2$ represents H, $L^1$ represents a C(O) group, $L^2$ represents a group combining $(CH_2—CH_2O)_x$ and $(CH_2CH(CH_3)O)_y$, or $(CH(CH_3)CH_2O)_z$, x represents an integer or decimal number between 10 and 140, y+z represents an integer or decimal number between 10 and 140 and x is strictly greater than y+z and the sum x+y+z is between 20 and 150, a compound of formula (I) in which $R^1$ and $R^2$ represent H, L' represents C(O), $L^2$ represents $(CH_2CH_2O)_x$ and x represents 1, a compound of formula (I) in which $R^1$ and $R^2$ represent H, L' represents C(O), $L^2$ represents $(CH_2CH(CH_3)O)_x$ or $(CH(CH_3)CH_2O)_z$ and y+z represents 1, a compound of formula (I) in which R' represents $CH_3$, $R^2$ represents H, L' represents C(O), $L^2$ represents a group $(CH_2—CH_2O)_x$ and x represents 1, a compound of formula (I) in which R' represents $CH_3$, $R^2$ represents H, L' represents C(O), $L^2$ represents a group $(CH_2—CH(CH_3)O)_y$ or $(CH(CH_3)CH_2O)_z$ and y+z represents 1, a compound of formula (I) in which $R^1$ represents $CH_3$, $R^2$ represents H, $L^1$ represents $CH)_2$, $L^2$ represents a group combining $(CH_2—CH_2O)_x$ and $(CH_2CH(CH_3)O)_y$ or $(CH(CH_3)CH_2O)_z$, x represents an integer or decimal number between 10 and 140, y+z represents an integer or decimal number between 10 and 140 and x is strictly greater than y+z and the sum x+y+z is between 10 and 150, a compound of formula (I) in which $R^1$ represents $CH_3$, $R^2$ represent H, L' represents $CH_2$, $L^2$ represents $(CH_2—CH_2O)_x$ and x represents an integer or decimal number between 10 and 140, and a compound of formula (I) in which $R^1$ and $R^2$ represent H, $L^1$ represents $O—CH_2—CH_2—CH_2—CH_2$, $L^2$ represents $(CH_2—CH_2O)_x$ and x represents an integer or decimal number between 10 and 140.

8. The detergent composition as claimed in claim 1, wherein, the copolymer is prepared by reacting 7 mol % to 18 mol % of compound (c) of formula (I) or the copolymer is prepared by reacting 7% to 18% by weight of compound (c) of formula (I).

9. The detergent composition as claimed in claim 1, wherein the non-sulfonated water-soluble copolymer is prepared by polymerization reaction also using a monomer (d) chosen from maleic acid, itaconic acid and crotonic acid, mixtures thereof and salts thereof, in a weight amount ranging from 1/20 to 1/3 relative to the amount of monomer (a).

10. The detergent composition as claimed in claim 1, comprising from 1% to 15% by weight of non-sulfonated water-soluble copolymer.

11. A scale-inhibiting and/or anti-spotting agent, comprising the detergent composition as claimed in claim 1, wherein the at least one non-sulfonated nonionic surfactant is selected from the group consisting of synthetic alcohol ethoxylates, alcohol ethoxylates of natural origin, tributyl phenol ethoxylates, nonyl phenol ethoxylates, block polymers of ethylene oxide and of propylene oxide, adducts of ethoxylated-propoxylated alcohols, fatty acid ethoxylates, fatty amine ethoxylates, castor oil ethoxylates, tristyryl phenol ethoxylates, alkyl polyglycosides, adducts of $C_{10}$-$C_{12}$ ethoxylated-propoxylated fatty alcohols, adducts of $C_{12}$-$C_{14}$ ethoxylated-propoxylated fatty alcohols, adducts of $C_{12}$-$C_{15}$ ethoxylated-propoxylated oxo-alcohols, adducts of $C_{12}$-$C_{18}$ ethoxylated-propoxylated oxo-alcohols, $C_{12}$-$C_{14}$ fatty alcohol ethoxylates comprising 10 ethylene oxide groups and bearing a butyl end function $C_{12}$-$C_{18}$ fatty alcohol ethoxylates comprising 5 ethylene oxide groups and bearing a butyl end function, $C_{12}$-$C_{18}$ fatty alcohol ethoxylates comprising 10 ethylene oxide groups and bearing a butyl end function, $C_{12}$-$C_{15}$ oxo-alcohol ethoxylates comprising 8 ethylene oxide groups, C12-C15 oxo-alcohol ethoxylates comprising 8 ethylene oxide groups, C12-C15 oxo-alcohol ethoxylates comprising 10 ethylene oxide groups, poly($C_6$-hexyl glycosides) and poly($C_8$-alkyl glucosides).

12. A cleaning process comprising:

washing with water and at least one detergent composition as claimed in claim 1;

rinsing; and drying.

13. The cleaning process as claimed in claim 12, wherein the washing or cleaning is chosen from the group consisting of washing a vehicle, detergency, laundry washing, washing or cleaning tableware, washing assistance, and surface cleaning.

14. The detergent composition as claimed in claim 1, wherein the compound (c) of formula (I) is a compound wherein:

$L^1$ represents a group chosen from C(O) and $CH_2$.

15. The detergent composition as claimed in claim 1, wherein the compound (c) of formula (I) is a compound wherein:

$L^2$ represents a group combining $(CH_2—CH_2O)_x$ and $(CH_2CH(CH_3)O)_y$ or $(CH(CH_3)CH_2O)_z$.

16. The detergent composition as claimed in claim 1, wherein the compound (c) of formula (I) is a compound wherein:

x represents an integer or decimal number between 10 and 140.

17. The detergent composition as claimed in claim 1, wherein the compound (c) of formula (I) is a compound wherein:

y+z represents an integer or decimal number between 10 and 140.

18. The detergent composition as claimed in claim 1, wherein the compound (c) of formula (I) is a compound wherein:

x is strictly greater than y+z and the sum x+y+z is between 20 and 150.

19. The detergent composition as claimed in claim 1, wherein the compound (c) of formula (I) is a compound wherein:

$R^1$ represents $CH_3$.

* * * * *